United States Patent [19]

Mutter

[11] Patent Number: 5,029,622

[45] **Date of Patent: * Jul. 9, 1991**

[54] GAS REFUELLING DEVICE AND METHOD OF REFUELLING A MOTOR VEHICLE

[75] Inventor: Heinz Mutter, Winterthur, Switzerland

[73] Assignee: Sulzer Brothers Limited, Winterthur, Switzerland

[ * ] Notice: The portion of the term of this patent subsequent to Oct. 30, 2007 has been disclaimed.

[21] Appl. No.: 388,162

[22] Filed: Aug. 1, 1989

[30] Foreign Application Priority Data

Aug. 15, 1988 [CH] Switzerland ..... 3058/88

[51] Int. Cl.[5] ..... B65B 31/00

[52] U.S. Cl. ..... 141/4; 141/83; 141/98; 141/94; 137/79; 222/54

[58] Field of Search ..... 141/4, 18, 21, 47, 48, 141/51, 63, 66, 94, 95, 83, 98, 231; 417/12; 368/8; 137/80, 552.7, 79; 222/54

[56] References Cited

U.S. PATENT DOCUMENTS

| | | | |
|---|---|---|---|
| 1,870,899 | 8/1932 | Lancey | 222/54 |
| 2,533,638 | 12/1950 | Thornton-Norris | 368/8 |
| 2,829,492 | 4/1958 | Kleinman | 137/79 |
| 3,334,679 | 8/1967 | Bruning et al. | 137/80 |
| 3,738,609 | 6/1973 | Divigard | 137/79 |
| 3,799,218 | 3/1977 | Douglass | 141/18 |
| 3,930,752 | 1/1976 | Douglas | 417/12 |
| 4,483,376 | 11/1984 | Bresie et al. | 141/95 |
| 4,527,600 | 7/1985 | Fisher et al. | 141/4 |
| 4,657,055 | 4/1987 | Poulsen | 141/83 |
| 4,705,082 | 11/1987 | Fanshawe et al. | 141/4 |

FOREIGN PATENT DOCUMENTS

| | | | |
|---|---|---|---|
| 0233959 | 9/1987 | European Pat. Off. . | |
| 2489477 | 3/1982 | France | 137/79 |
| 2159495 | 12/1985 | United Kingdom | 141/94 |
| 2172984 | 10/1986 | United Kingdom . | |

*Primary Examiner*—Henry J. Recla
*Assistant Examiner*—Casey Jacyna
*Attorney, Agent, or Firm*—Kenyon & Kenyon

[57] ABSTRACT

The gas refuelling device for a motor vehicle comprises a compressor unit, a gas distributor unit and a control unit inside a housing and an external operating unit. At least one temperature sensor and one pressure sensor deliver measured values to the control unit, which has stored set values which are adapted to the changing environmental and operating conditions. When actual values deviate from their set values, the operating state of the gas refuelling device is altered. The operating states are selected such that the device closes down if there are serious incorrect manipulations or components fail and can only be made ready for operation again with auxiliary devices.

29 Claims, 4 Drawing Sheets

GAS REFUELLING DEVICE AND METHOD OF REFUELLING A MOTOR VEHICLE

This invention relates to a gas refuelling device and to a method for refuelling a motor vehicle.

As is known, gas refuelling devices for motor vehicles are currently being used on an experimental basis in areas where natural gas can be obtained at a low cost. The motor vehicles are provided with a change-over unit for gas operation and with a pressure tank which permits pressures of up to 200 bar and which is filled with compressed gas. Components for filling stations of this kind are described in Swiss patent applications: 04560/86-6; and 00882/88-0 and U.S. patent application Ser. No. 07/223,284, filed July 22, 1988 and U.S. Pat. No. 4,936,327.

The components, such as compressors, valves, control elements and construction parts, of all the mentioned applications represent partial solutions for the manufacture of standard refuelling devices. They have not yet been combined in a system which allows for the change in the thermodynmic properties of the gas as a function of the external conditions, nor do the safety measures taken with respect to the actual device cover use by untrained private persons.

Other types of fuel storage and dispensing systems have also been described in U.S. Pat. No. 3,799,218; UK patent application 2,172,984; and European patent application 0233959. However, none describes a system which takes into account the changes in the thermodynamic properties of a gas as a function of external conditions.

Accordingly, it is an object of the invention to be able to use a gas refuelling device in a private household.

It is another object of the invention to be able to provide a gas refuelling device for individuals to use without entailing an unnecessary risk to the individuals and property.

It is another object of the invention to be able to automatically evaluate incorrect manipulations and changing boundary conditions during a refuelling operation to maintain a refuelling device in an operating state adapted to the situation.

It is another object of the invention to provide a gas refuelling device which can be utilized in a reliable manner.

Briefly, the invention provides a gas refuelling device which comprises a gas distribution means for dispensing a flow of gas, a compressor unit for pumping the flow of gas in the gas distribution means and a control unit for operating the device in one of four operating states including READY FOR OPERATION, NOT READY FOR OPERATION, IN OPERATION and SERVICE MODE.

In accordance with the invention, the gas refuelling device includes at least one temperature sensor and at least one pressure sensor connected to the control unit. The temperature sensor is utilized for sensing the temperature of ambient air external to the refuelling device and generating an actual value signal in response thereto while the pressure sensor senses the pressure of the gas flow in the gas distribution means and generates an actual value signal in response thereto. The control unit compares the signals from the sensors with a respective range of permissible values for each signal and functions to switch the refuelling device to the NOT READY FOR OPERATION stage in response to a deviation of the actual pressure value signal from the range of permissible values therefor.

For example, the four operating states of IN OPERATION, READY FOR OPERATION, NOT READY FOR OPERATION, and SERVICE MODE differ by the fact that the user always brings about the transition from the READY FOR OPERATION state to the IN OPERATION state when giving a starting signal and the transition from the IN OPERATION state to the READY FOR OPERATION state when giving a stop signal, while only indirectly achieving the transition from the NOT READY FOR OPERATION to the READY FOR OPERATION state by eliminating the faults indicated by the control unit.

The control unit automatically causes a change from the IN OPERATION state to the READY FOR OPERATION state when a maximum refuelling pressure, which is dependent on the outside temperature, is reached, while if boundary conditions are violated, e.g. a shut-off valve in the gas connection line is closed, the NOT READY FOR OPERATION state is triggered. All serious changes, such as a permissible set value range for pressure changes being exceeded and/or components of the device failing, result in the control unit causing a transition to the SERVICE MODE state, and a return from this state to the READY FOR OPERATION state can only be achieved by trained staff using auxiliary devices.

An advantage of the refuelling device lies in the fact that consistent monitoring of the refuelling operation is only made possible because set/actual value comparisons between pressures and temperatures are carried out at short time intervals, the permissible set values being corrected according to the development of the preceding measurements. Very quick reactions are possible due to the short time interval and the process of monitoring the changes of the gradient of a function.

A further advantage arises where, when the pressures are low, checks are carried out regarding the lack of a pressure increase at the beginning of a refuelling operation, for the purpose of detecting unconnected or defective fuel hoses and an automatic stoppage.

In order to prevent servicing work on the compressor unit from being neglected, the refuelling device is provided with operating time meter, the counting memory of which is removed with the compressor as a part of the compressor and can only be reset to zero with auxiliary devices. Control of the device is guaranteed by a preset limit to the operating hours per compressor and the device spontaneously closing down if this limit is exceeded, with warning signals being given and the possibility of recalling the actual number of operating hours being provided.

It has also proved advantageous to include the switching behavior of elements of the gas distribution system, which are disposed outside the device, when evaluating the monitoring process upon starting up a refuelling device. In addition, the behavior of the device is controlled such that brief current interruptions only interrupt the refuelling operation, whereas a start signal has to be given after longer current interruptions. The refuelling device thus enables a standard gas refuelling device to be produced which is highly reliable, is provided with the necessary measuring and evaluation systems for compensating for the environmental effects on the thermodynamic state variables and is suitable for use by private persons for refuelling motor vehicles These and other objects and advantages of the invention with become more apparent from the following detailed description taking in conjunction with the accompanying drawings wherein:

FIG. 1 diagrammatically illustrates a gas refuelling device according to the invention, showing the essential components and their connections for carrying out a refuelling cycle;

FIG. 2 diagrammatically illustrates four operating states of a gas refuelling device with the possible transitions and the triggers responsible for these;

Figure 1:
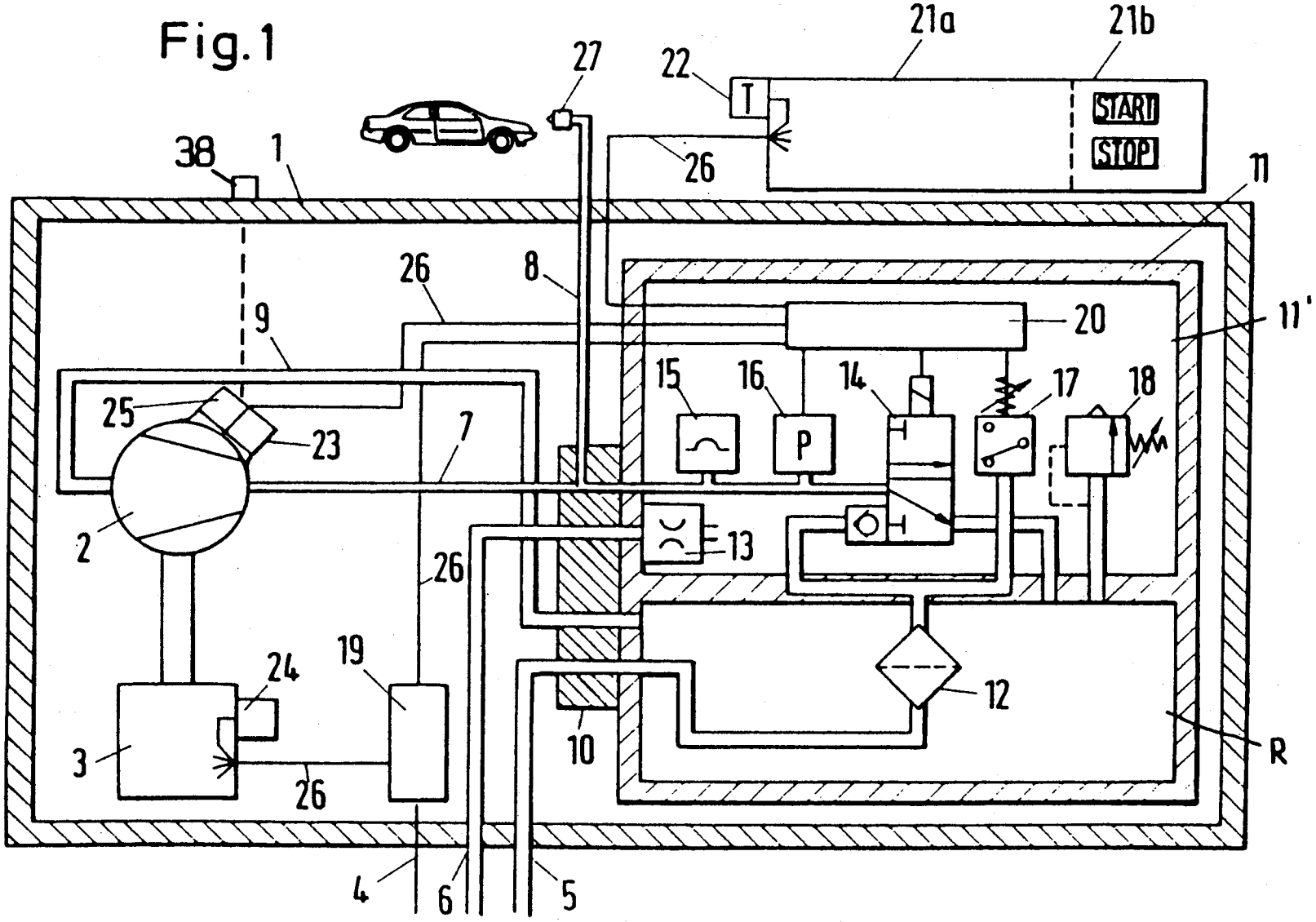

Referring to FIG. 1, the gas refuelling device includes a housing 1 which can be mounted on any suitable type of facility and which, for example, may be connected with a grid. In addition, the refuelling device includes a gas distribution means within the housing 1 for dispensing a flow of gas therefrom. As indicated, the gas dispensing means includes a compressor unit having a compressor 2 for pumping a flow of pressurized gas therethrough and a motor 3 for driving the compressor 2. An electrical connection lead 4 is provided for supplying energy for running of the motor 3 in a conventional fashion.

The gas distribution means also includes a reservoir R located within a sub-housing 11 inside the housing 1, a gas connection line 5 for delivering a flow of gas into the reservoir R, for example via a suction filter 12, and a switching means in the form of a reversing valve 14. A differential pressure switch 17 is also connected to the gas connection line 5 to vent the line 5 into a second chamber 11' inside the sub-housing 11 in response to an excess pressure in the line 5. A vent line 6 also leads through the housing 1 and communicates via a bleeder throttle 13 with the second chamber within the sub-housing 11.

An outlet line 9 connects the reservoir R to the compressor 2 in order to deliver gas therethrough while a gas pressure line 7 connects with the compressor 2 to deliver gas therefrom. As indicated, the gas connection line 7 communicates with a hose 8 through which the gas can be dispensed through a suitable outlet, such as a coupling 27 for filling a gas tank in a motor vehicle. The gas connection line 7 also communicates via a bursting disk 15, a pressure sensor 16 for sensing the pressure of the gas flow in the line 7 and the switching reversing valve 14 for recycling gas from the compressor 2 into the reservoir A pressure relief valve 18 is also mounted within the sub-housing 11 to vent the reservoir should an excess pressure arise therein to the other chamber in the sub-housing 11.

As illustrated, a control unit 20 is provided in the sub-housing 11 for operating the refuelling device in one of four operating states including READY FOR OPERATION, NOT READY FOR OPERATION, IN OPERATION and SERVICE MODE. The pressure sensor 16 functions to sense the pressure in the gas flow in the line 7 and to generate an actual value signal in response thereto which is delivered into the control unit 20. This actual value signal is then compared in the control unit 20 to permissible values for the pressure signal in order to generate a control signal in response to a deviation of the actual value signal from a range of permissible values.

In addition, an operating unit is disposed to the exterior on the housing 1 and includes an indicator panel 21*a* having means (not shown) for visually displaying an indication of each of the operating stages of the refuelling device. In addition, the operating unit includes an operating panel 21*b* which contains a start button and a stop button, each of which is connected with the control unit 20. For example, the start button serves to switch the control unit 20 from the READY FOR OPERATION stage to the IN OPERATION stage while the stop button switches the control unit 20 from the IN OPERATION stage to the READY FOR OPERATION stage.

The operating unit also includes a temperature sensor 22 for sensing the temperature of ambient air external to the refuelling device and for generating an actual value signal in response thereto. The resulting actual value signal is delivered via a suitable line 26 to the control unit 20 for comparison therein with a range of permissible values for the temperature signal.

As illustrated, the compressor 2 is provided with a sensor 23 for sensing the cooling air temperature of the compressor 2 as well as with an operating time meter 25 having a memory for recording the time of operation of the compressor unit. A signal means 38 may also be connected with the time meter 25 to generate a warning signal before a selected time of operation is exceeded. The sensor 23 and memory 25 are connected by a suitable line 26 with the control unit 20. Likewise, a sensor 24 is provided on the electric motor 3 for sensing the winding temperature. This sensor 24 is also connected by a suitable line 26 with a switching means 19 in the electrical connection line 4. A fan (not shown) may also be provided for cooling the motor 3.

The switching means 19 is also connected by a suitable electrical line 26 to the control unit 20.

As indicated, a mounting block 10 can be provided on the sub-housing 11 in order to secure the connections for the various lines 5, 6, 7, 8, 9.

Figure 2:
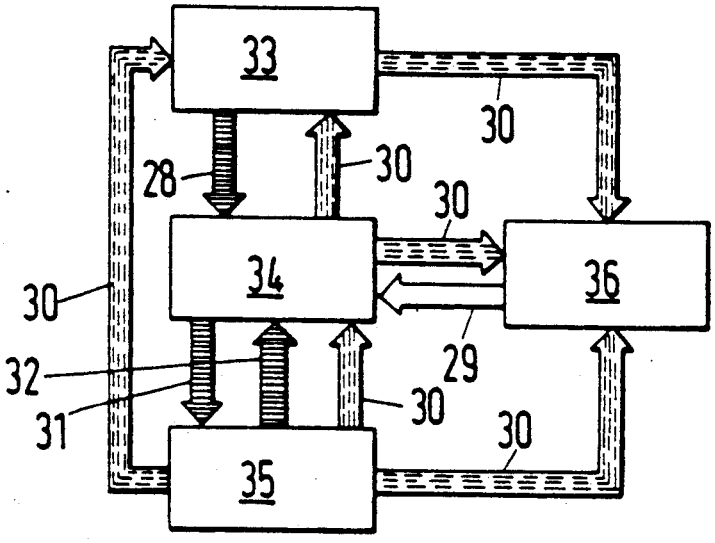

Referring to FIG. 2, the refuelling device is operated in a manner so that the device can be readily activated by a user in order to dispense gas therefrom while at the same time, the various switching means and signal transmitters serve to control the operation of the refuelling device should the sensed temperatures and pressures deviate from the set value ranges therefore. In this respect, the user triggers a change 31 from the READY FOR OPERATION stage 34 to the IN OPERATION stage 35 by means of the start button on the operating panel 21*b* (see FIG. 1) while causing the refuelling operation to stop prematurely by means of the stop button initiating a change 32 back to the READY FOR OPERATION stage 34.

During operation should a fault occur, for example, should the actual temperature/pressure value deviate from the respective set value range, a change 30 is triggered by the control unit 20 (see FIG. 1) so as to switch into the NOT READY FOR OPERATION stage 33. Should the change 30 be of significant nature, the refuelling device is switched into the SERVICE MODE.

After elimination of the faults indicated by the control unit, the user may indirectly trigger a change 28 so as to change the refuelling device from the NOT READY FOR OPERATION stage 33 to the READY FOR OPERATION stage 34. A normal start-stop cycle can then be instituted. On the other hand, in order to effect a change from the SERVICE MODE stage 36, service personnel are required along with separate auxiliary devices.

Figure 3:
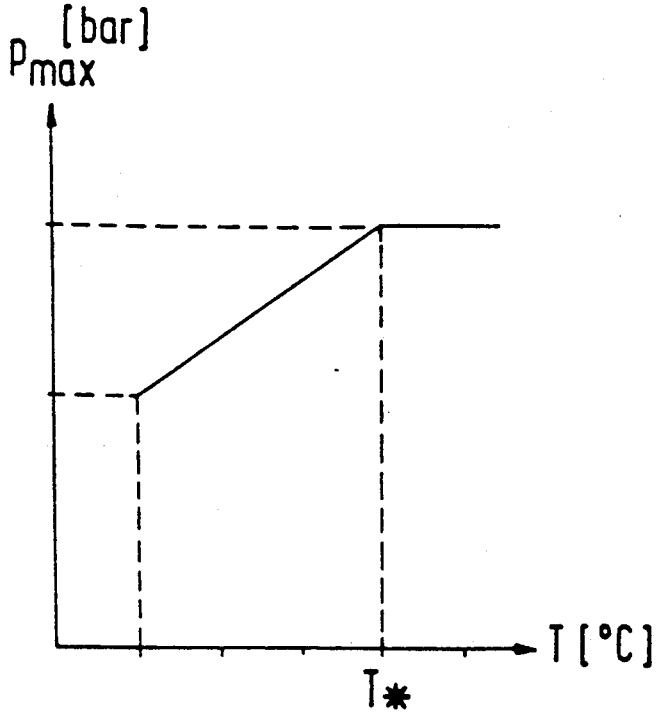
FIG. 3 is a graph for the maximum permissible refuelling pressure pmax as a function of the outside temperature T.

Referring to FIG. 3, in order to compensate for changes in temperature in the ambient atmosphere, a set value correction is incorporated into the circuitry of the control unit which may be in the form of a digital computer. As indicated, the set value correction for the given maximum pressure pmax is a function of the outside temperature T during the refuelling operation and rises in a linear manner up to a temperature T* and, thereafter, has a constant value, corresponding to the pressure from T*, at temperatures higher than T*.

Figure 4:
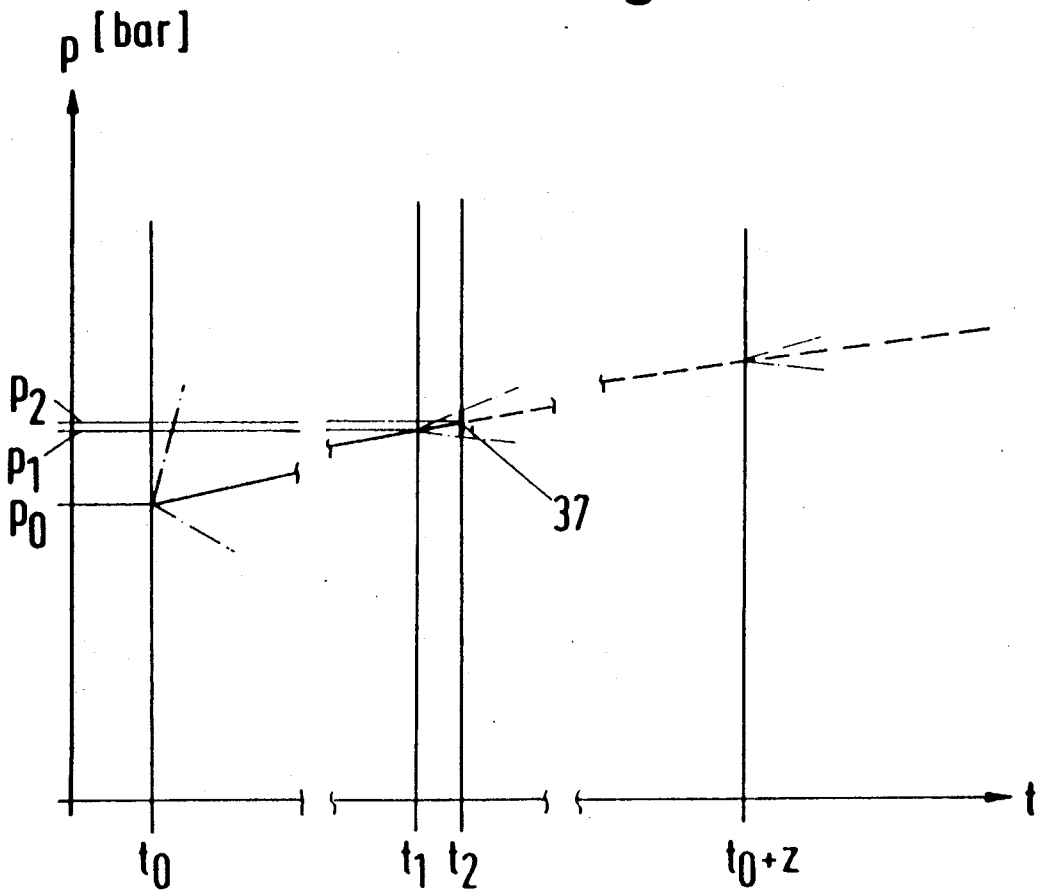
FIG. 4 is a graph illustrating a rise in the refuelling pressure p as a function of the time t during a refuelling operation.

A set value correction for the range of permissible pressure changes for the refuelling pressure p during the refuelling operation is shown in FIG. 4 with a pressure rise during the time from tO to t2, which is shown by a broken line for constant boundary conditions beyond the time t0+z. The pressure deviations, which vary with the environmental conditions and the refuelling time, at a time interval t2−t1 are indicated by a variable spread of the permissible curve course at the times t0, t2 and t0+z.

Figure 5:
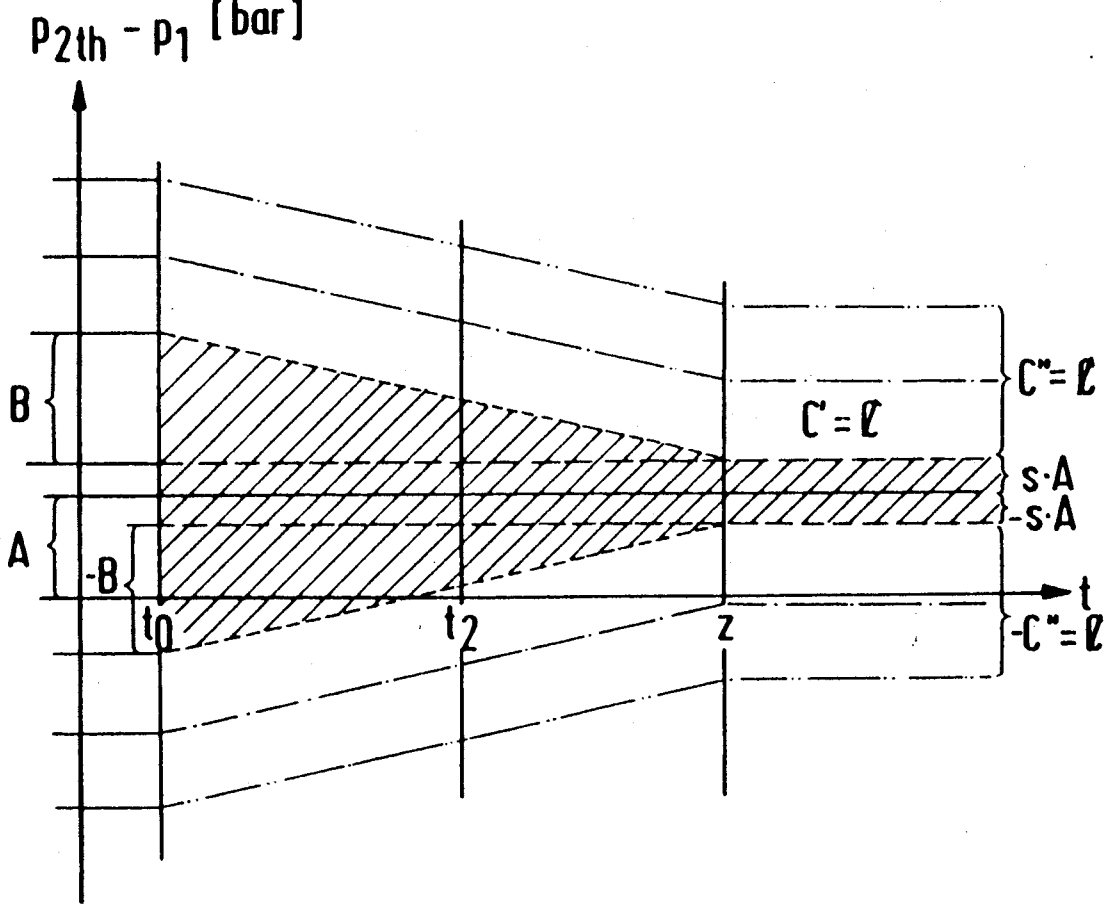
FIG. 5 is a graph in which possible set values for the pressure deviations of the refuelling pressure at constant interrogation intervals are shown over the refuelling time t.

FIG. 5 shows a graph for a continuous calculation of the set values for the deviations of the refuelling pressure during a refuelling operation. For example, given a constant outside temperature and taking account of the initial refuelling pressure p0 of the value B and of a constant interrogation interval t2−t1, the permissible pressure deviations must lie within the hatched area. Changes in the outside temperature at a time interval t2−t1 shift the permissible set values for pressure deviations by a value C, which depends, inter alia, on the pressure p1 at the time t1. This displacement is indicated by the lines C′=constant and C″- constant.

During refuelling, the refuelling pressure is constantly measured by the pressure sensor 16 and compared with a given maximum pressure and, if the latter is exceeded, causes the refuelling operation to cease. The given maximum pressure is determined according to the formula $pmax=a+b\cdot T$ in the range T<T* and according to the formula $pmax=a+b\cdot T^*$ in the range T>T*, in which T is the measured outside temperature. The sign of the coefficient b is positive and the values of the constants a, b, T* are determined by the thermodynamic state variables of the gas mixture which is used.

An actual pressure change for the refuelling pressure is also continuously measured with the pressure sensor 16 at time intervals t2−t1 during refuelling and compared with a range of pressure changes permissible at the time t2 and switches off the refuelling device if deviations are found. Permissible pressure changes for the time t2 are calculated by the control unit 20 from the measured value of the outside temperature T2 from the temperature sensor 22 at the time t2 and from the measured values for the refuelling pressure t1 from the pressure sensor 16 and from the outside temperature T1 from the temperature sensor 22 at the time t1 and from the measured value for the refuelling pressure p0 from the pressure sensor 16 at the time t0 at the beginning of the refuelling operation.

A formula of the type $$P_{2th} - P_1 = \left(\frac{dp}{dt}\right)_V (t_2 - t_1)(1 \pm S) \pm$$

$$A$$

$$P_0\left(\frac{dp}{P}\right)_{\Delta Tmax} \cdot \frac{t_2 - t_1}{z} \cdot$$

$$B$$

$$\frac{z - t_2}{z} + P_1\left(\frac{dp}{P}\right)_{\Delta TK} \cdot \frac{T_2 - T_1}{\Delta T_K}$$

$$C$$

is used for continuously calculating the set value range for the permissible pressure change and is simplified for the constant time interval t2−t1 to:

$$P_{2th} - P_1 = A(1 \pm S) \pm B\frac{z + t_2}{z} + P_1\left(\frac{dp}{P}\right)_{\Delta TK} \cdot \frac{T_2 - T_1}{\Delta T_K}$$

with the condition that for t2>z t2 is set equal to z, with the definitions:

T : outside temperature
P : refuelling pressure
t : time
subscript 0 : time of beginning of refuelling operation
subscript 1 : time of last measurement
subscript 2 : time of new measurement
subscript 2th : re-defined set value
z : time interval for approximate temperature equalization between the vehicle tank and the outside temperature;
(dp) : time-dependent pressure rise, resulting
(dt)v from the capacity of the vehicle tank and the volumetric delivery of the compressor;
(dp) maximum relative pressure change which
(p)$\Delta T_{max}$ may occur due to a maximum temperature difference Δ Tmax between the vehicle tank and the surroundings at the beginning of the refuelling operation;
(dp) maximum relative pressure change which
(p)$_{\Delta Tk}$ may occur due to the change in the outside temperature by $\Delta T_k$ with the daily climate within a usual refuelling period;
s : variance addition for measurement uncertainties, linearized calculation processes and variable gas compositions.

Given a refuelling pressure of p<20 bar, the pressure sensor 16 detects the lack of a pressure increase for the refuelling pressure p2 with respect to p1 at short time intervals t2−t1, the control unit 20 then checks whether p2<p1 is true and, if so, switches off the refuelling device.

The start of a refuelling operation is dependant on the measurements by the temperature and pressure sensors 16, 17, 22, 23, 24 and pre-selected reference values. Further, there is no evaluation of the measured values from the sensors 16, 17, 22 for a brief time, which is dependant on elements of the gas distribution system outside the device when the device is started up. The refuelling operation may be limited in time according the maximum usual tankage of fueled motor vehicles as a further precaution.

Further, should a brief power failure occur during a refuelling operation, for example with the device in the IN OPERATION state 35, the refuelling operation is continued until other criteria result in a disconnection. The refuelling device may switch itself off in a case of long term current interruptions. Further, should elements such as the sensors, valves and other components fail to function, the refuelling device closes down in the SERVICE MODE state.

The invention thus provides a gas refuelling device and a method of refuelling motor vehicles in which incorrect manipulations and changing boundary conditions are automatically evaluated during the refuelling operation so that the device can be automatically and continuously maintained in an operating state which is adapted to the situation.

The invention further enables a standard gas refuelling device to be constructed which can be leased to private households without an unnecessary risk to lives and property and/or legally ambiguous situations between an owner and lessee.

The invention also provides a refuelling device which permits refuelling to be performed in an unsupervised manner by a user, for example, on an overnight basis. This is due, in part, to the continuous and automatic correction of the set values for the permissible deviations of the thermodynamic state variables during a refuelling operation.

What is claimed is:

1. A gas refuelling device capable of operating in one of at least two operating states, said device comprising a gas distribution means for conveying gas therethrough to an outlet;

a compressor unit for pumping the flow of gas in said gas distribution means;

at least one temperature sensor for sensing the temperature of ambient air external to said device and generating an actual value signal in response thereto;

at least one pressure sensor for sensing the pressure of the gas flow in said gas distribution means and generating an actual value signal in response thereto; and a control unit for operating said gas distribution means in one of an IN OPERATION state and a NOT READY FOR OPERATION state, said control unit being connected to each sensor to receive a respective signal therefrom for comparison with a respective range of permissible values for said respective signal and to generate a control signal in response to a deviation of a respective actual value signal from a respective range of permissible values therefor to change said control unit from said IN OPERATION state to said NOT READY FOR OPERATION state.

2. A gas refuelling device as set forth in claim 1 wherein said control unit has means for increasing said range of permissible values for said pressure signal in response to an increase in said actual temperature signal during a refuelling operation.

3. A gas refuelling device as set forth in claim 2 wherein said latter means increases said range of permissible values for said pressure signal up to a predetermined increase in said actual temperature signal and maintains said range constant in response to a further increase in said actual temperature signal

4. A gas refuelling device as set forth in claim 1 which further comprises an operating time meter connected with said compressor unit for recording the time of operation of said compressor unit.

5. A gas refuelling device as set forth in claim 4 which further comprises signal means connected with said operating time meter to generate a warning signal before a selected time of operation is exceeded.

6. A gas refuelling device as set forth in claim 1 wherein said control unit is a digital computer.

7. A gas refuelling device comprising a gas distribution means for dispensing a flow of gas therefrom;

a compressor unit for pumping the flow of gas in said gas distribution means;

a control unit for operating said refuelling device in one of four operating states including READY FOR OPERATION, NOT READY FOR OPERATION, IN OPERATION and SERVICE MODE;

at least one temperature sensor for sensing the temperature of ambient air external to said device and generating an actual value signal in response thereto;

at least one pressure sensor for sensing the pressure of the gas flow in said gas distribution means and generating an actual value signal in response thereto; and said control unit being connected to each sensor to receive a respective signal therefrom for comparison with a respective range of permissible values for said respective signal and to switch said refuelling device into said NOT READY FOR OPERATION state in response to a deviation of a said actual pressure value signal from said range of permissible values therefor.

8. A gas refuelling device as set forth in claim 7 wherein said control unit has means for increasing or decreasing said range of permissible values for said pressure signal in response to a corresponding increase or decrease in said actuation temperature signal during a refuelling operation.

9. A gas refuelling device claim 8 which further comprises an operating unit connected to said control unit and having a start button to switch said control unit from said READY FOR OPERATION stage to said IN OPERATION stage and a stop button to switch said control unit from said IN OPERATION stage to said READY FOR OPERATION stage.

10. A gas refuelling device claim 8 which further comprises an operating time meter connected with said compressor unit for recording the time of operation of said compressor unit.

11. A gas refuelling device as set forth in claim 8 wherein said gas distribution means includes a reservoir for receiving gas, an outlet line connecting said reservoir to said compressor unit to deliver gas thereto, a gas pressure line connected to said compressor unit to deliver gas therefrom and having said pressure sensor connected thereto, a hose connected to said gas pressure line to dispense gas therefrom in said IN OPERATION state and a reversing valve connected between said pressure line and said reservoir for recycling gas from said compressor unit to said reservoir.

12. A gas refuelling device claim 11 wherein said control unit is connected to said reversing valve to activate said valve to deliver gas to said reservoir in response to said control unit switching from said IN OPERATION stage to said NOT READY FOR OPERATION stage.

13. A gas refuelling device claim 8 which further comprises an electrical connection line for delivering electrical energy to said compressor unit and switching means connected between said control unit and said electrical connection line to deactivate said compressor unit upon switching of said device into said SERVICE MODE.

14. A gas refuelling device claim 7 which further comprises an indicator panel having means for visually displaying an indication of each of said operating stages.

15. A method for refuelling a motor vehicle comprising the steps of delivering a flow of pressurized gas to the vehicle from a refuelling device;

sensing the temperature of ambient air external to the refuelling device;

sensing the pressure of the gas flow; and controlling the refuelling device in response to the sensed temperature and pressure to operate in one of four operating stages including READY FOR OPERATION, NOT READY FOR OPERATION, IN OPERATION and SERVICE MODE whereby in response to said pressure deviating from a permissible range of pressure, the device is switched into said NOT READY FOR OPERATION stage.

16. A method as set forth in claim 15 wherein in response to an increasing or decreasing, sensed temperature, said permissible range of pressure deviations is correspondingly increased or decreased as a function of refuelling time.

17. A method as set forth in claim 15 wherein the refuelling device is switchable from said NOT READY FOR OPERATION stage to said READY FOR OPERATION stage by a user and unswitchable from said SERVICE MODE to another stage by the user.

18. A method as set forth in claim 15 wherein the maximum refuelling pressure is dependent on the level of ambient temperature.

19. A method as set forth in claim 15 wherein the refuelling device switches from said IN OPERATION stage to said NOT IN OPERATION stage in response to its sensed pressure falling below a predetermined pressure within a predetermined time interval.

20. A method as set forth in claim 15 which further comprises the steps of determining a change in temperature of ambient air over a predetermined period of time adjusting said permissible range of pressure in response to a determined change in ambient air temperature; and switching the refuelling device into said NOT READY FOR OPERATION stage in response to said sensed pressure falling outside said permissible range of pressure during a predetermined start-up time for refuelling operation.

21. A method as set forth in claim 15 which further comprises the step of delaying said step of controlling the refueling device until after an initial start-up of the refueling device.

22. A method as set forth in claim 15 which further comprises the step of limiting operation of the refuelling device in time in accordance with a maximum fuel capacity of a fuel tank of a vehicle.

23. A method as set forth in claim 15 which further comprises the steps of switching the refuelling device from said IN OPERATION stage to said NOT READY FOR OPERATION stage in response to a power failure during refuelling, switching the device from said NOT READY FOR OPERATION stage to said IN OPERATION stage after a preset brief time delay in restoring power and keeping the device in said NOT READY FOR OPERATION stage when the power failure exceeds a second preset time delay.

24. A method as set forth in claim 15 which further comprises the step of switching the device into said SERVICE MODE in response to a failure to sense at least one of said temperature and said pressure.

25. A gas refuelling device capable of operating in one of at least two operating states, said device comprising a gas distribution mean for conveying gas therethrough to an outlet;

at least one pressure sensor for sensing the pressure of the gas flow in said gas distribution means and generating an actual value signal in response thereto;

a control unit connected to said pressure sensor to receive an actual value signal therefrom for comparison with a range of permissible values for said signal and to generate a control signal in response to a deviation of an actual value signal from said range of permissible values therefor to change said device from one operating state to another of said operating states;

at least one temperature sensor for sensing the temperature of ambient air external to said device and generating an actual value signal in response thereto; and means in said control unit connected to said temperature sensor to receive an actual value signal therefrom for increasing or decreasing said range of permissible values for said pressure signal in response to a corresponding increase or decrease in said actual temperature signal during a refuelling operation.

26. A gas refuelling device as set forth in claim 25 wherein said latter means increases said range of permissible values for said pressure signal up to a predetermined increase in said actual temperature signal during a refuelling operation.

27. A gas refuelling device as set forth in claim 25 which further comprises a compressor unit for pumping the flow of gas in said gas distribution means and an operating time meter connected with said compressor unit for recording the time of operation of said compressor unit.

28. A gas refuelling device as set forth in claim 27 which further comprises signal means connected with said operating time meter to generate a warning signal before a selected time of operation is exceeded.

29. A gas refuelling device as set forth in claim 25 wherein said control unit is programmed for operating said refuelling device in one of four operating states including READY FOR OPERATION, NOT READY FOR OPERATION, IN OPERATION and SERVICE MODE, and which further comprises an operating unit connected to said control unit and having a start button to switch said control unit from said READY FOR OPERATION stage to said IN OPERATION stage and a stop button to switch said control unit from said IN OPERATION stage to said READY FOR OPERATION stage.

* * * * *

UNITED STATES PATENT AND TRADEMARK OFFICE

CERTIFICATE OF CORRECTION

PATENT NO. : 5,029,622

DATED : July 9, 1991

INVENTOR(S) : HEINZ MUTTER

It is certified that error appears in the above-identified patent and that said Letters Patent is hereby corrected as shown below:

Column 4, line 52 change "therefore." to -therefor.-

Column 6, line 68 change "according" to -according to-
Column 8, line 43 change "device" to -device as set forth in-
Column 8, line 50 change "device" to -device as set forth in-
Column 8, line 65 change "device" to -device as set forth in-
Column 9, line 3 change "device" to -device as set forth in-
Column 9, line 10 change "device" to -device as set forth in-
Column 7, line 68 change "signal" to -signal.-
Column 10, line 16 change "mean" to --means--.

Signed and Sealed this

Ninth Day of March, 1993

*Attest:*

STEPHEN G. KUNIN

*Attesting Officer*

*Acting Commissioner of Patents and Trademarks*